US006045170A

United States Patent [19]

Allen

[11] Patent Number: 6,045,170

[45] Date of Patent: Apr. 4, 2000

[54] DISPOSAL DEVICE

[76] Inventor: Anthony Allen, The Mill House, Clondulane, Fermoy, County Cork, Ireland

[21] Appl. No.: 09/122,805

[22] Filed: Jul. 27, 1998

[30] Foreign Application Priority Data

Jul. 25, 1997 [IE] Ireland ..... S 970543

[51] Int. Cl.[7] ..... A01K 29/00; E01H 1/12

[52] U.S. Cl. ..... 294/1.3; 294/25

[58] Field of Search ..... 294/1.3, 1.4, 25, 294/55; 15/104.8, 227, 257.1, 257.6; 383/4

[56] References Cited

U.S. PATENT DOCUMENTS

| | | | |
|---|---|---|---|
| 3,739,418 | 6/1973 | Yonaites et al. | 294/1.3 |
| 3,978,540 | 9/1976 | Peck et al. | 294/1.3 |
| 4,132,442 | 1/1979 | Larsson | 294/1.3 |
| 4,959,881 | 10/1990 | Murray | 294/1.3 X |

FOREIGN PATENT DOCUMENTS

| | | | |
|---|---|---|---|
| 37355 | 10/1981 | European Pat. Off. | 294/1.3 |
| 0351600 | 1/1990 | European Pat. Off. . | |
| 2686634 | 7/1993 | France | 294/1.3 |
| 2698113 | 5/1994 | France | 294/1.3 |
| 2836568 | 3/1980 | Germany . | |
| 2935502 | 3/1981 | Germany . | |
| 3326305 | 8/1984 | Germany . | |
| 88 10 840 | 12/1988 | Germany . | |
| 3909418 | 11/1989 | Germany | 294/1.3 |
| 3912972 | 11/1989 | Germany . | |
| 83 21 533 | 10/1990 | Germany . | |
| 39 33 341 | 4/1991 | Germany . | |
| 661 077 | 6/1987 | Switzerland . | |
| 661077 | 6/1987 | Switzerland | 294/1.3 |
| 91 15948 | 10/1991 | WIPO . | |
| WO92/08345 | 5/1992 | WIPO . | |
| WO94/09212 | 4/1994 | WIPO . | |
| 95 04457 | 2/1995 | WIPO . | |
| WO98/01375 | 1/1998 | WIPO . | |

*Primary Examiner*—Johnny D. Cherry
*Attorney, Agent, or Firm*—Jacobson, Price, Holman & Stern, PLLC

[57] ABSTRACT

A disposal device is used for disposal for messy dirt such as dog excrement. The device provides a disposal action analogous to that of a dustpan and brush. A scooper is pushed underneath the dirt on the near side, while a scraper pushes the dirt towards the scooper. The dirt falls into the interior of the bag via a chute connecting the scooper to a wall of the bag. The scooper and the scraper are dropped into the bag and the bag is then sealed by a seal.

24 Claims, 4 Drawing Sheets

DISPOSAL DEVICE

FIELD OF THE INVENTION

The invention relates to a disposal device for disposal of messy items such as pet excrement, food, or vomit. More generally, the invention relates to a disposal device for disposal of messy dirt for which a dustpan and brush, vacuum cleaner, or other conventional disposal devices are not suitable.

PRIOR ART DISCUSSION

Heretofore, some such disposal devices have been proposed. German Specification No. DE 3912972 describes such a device. The device comprises a bag and a scraper attached to the top end of the bag. The scraper is turned inside the bag together with the dirt. While this arrangement does provide a means to assist in picking up the dirt, it appears that such a device would be awkward to use and the dirt would not be cleanly picked, and it would therefore not gain widespread acceptance in the marketplace. German Specification No. DE 2836568 describes a device having a bag, a scraper, and an adhesive strip. The adhesive strip is adhered to the surface such as a pavement to assist in scraping the dirt. It appears that this device would also be awkward to use, and there are many situations in which the surface would not be suitable for adherence of the strip. PCT Specification No. WO 92/08345 describes a device in which a pair of blades are pressed against sides of a bag and the bag sides are subsequently turned inside out to leave the blades on the outside. Because the blades do not contact the dirt, they remain clean. It appears that this arrangement would also be awkward to use, and it also comprises a number of parts, which adds to production expense.

PCT Specification No. WO 98/01375 describes a device in which a scissors-type arrangement is used in conjunction with a bag. This arrangement appears to be complex because of the need for an operating mechanism, and it also appears to be quite bulky.

German Specification No. DE 3326305 describes a device which is an assembly of a bag and separate blades. The blades are inserted through slits in the bag from the outside. The assembly is placed directly over the dirt and the blades are rotated around into the bag until the leading edges are within the bag and the trailing ends protrude out from the bag mouth. It appears that use of this device would be awkward because the dirt is not visible as it is being picked. Also, the device is not compact and convenient to carry because it initially comprises three separate parts and, after use, the blades protrude from the bag in a bulky manner. European and German Specification Nos. DE 2935502 and EP 351600 both describe devices in which a strengthened rim is used to scrape the dirt into the bag. It appears that such an action is awkward and it would be difficult to keep one's hands and the bag external surfaces completely clean. PCT Specification No. WO 94/09212 describes a bag having a triangular reinforced mouth rim. Again, it appears that it would be difficult to effectively pick all of the dirt while keeping one's hands and the external surface of the bag clean.

Therefore, while many devices have been proposed addressing the same problem as the present invention, none of them are entirely satisfactory.

OBJECTS OF THE INVENTION

The invention is directed towards providing a disposal device which provides;

compact construction for ease of carrying devices available for use, for example, when walking a dog, or in a vehicle, ease of use, whereby the user can quickly and conveniently pick dirt without getting his or her hands or the external surface dirty, and simple construction, for low cost manufacture.

SUMMARY

According to the invention, there is provided a disposal device comprising:

a bag comprising:

least two walls, each having an inner surface and an outer surface, and a bag mouth; and a scraper connected to the bag, wherein:

the scraper is connected to a first bag wall at the inner surface of said bag wall, and the device further comprises a scooper connected to a second bag wail at the inner surface of said bag wall.

By providing a scraper and a scooper connected in this manner, the invention allows the user to pick dirt in a manner similar to the action with a dustpan and brush. This is a simple and natural action, and allows the user to easily avoid getting his or her hands dirty.

In one embodiment, the scraper is connected to the first bag wall by a chute of flexible material. This allows easy and simple delivery of din into the bag.

In one embodiment, the chute has a width approximately equal to that of the scraper. In one embodiment, the first bag wall and the scraper chute are of plastics material, and the scraper chute is connected to the first bag wall by a heat seal.

In another embodiment, the scooper is connected to the second bag wall by a chute of flexible material. This allows simple and easy delivery of dirt into the bag. Preferably, the chute has a width approximately equal to that of the scooper blade.

In one embodiment, the scraper comprises an integral handle, and preferably, the scraper handle extends from a central portion of a scraper blade. This provides simplicity.

In another embodiment, the scooper comprises an integral handle and preferably, the scooper handle extends transversely of a scooper blade.

In one embodiment, the device further comprises a tab connected to a bag wall at the outer surface of said bag wall adjacent to the bag mouth.

Preferably, the bag mouth comprises a sealing means. This allows easy and safe disposal.

In one embodiment, the bag is of plastics material.

Preferably, the bag walls are opaque.

DETAILED DESCRIPTION OF THE INVENTION

BRIEF DESCRIPTION OF THE DRAWINGS

The invention will be more clearly understood from the following description of some embodiments thereof, given by way of example only with reference to the accompanying drawing in which.

Figure 1:
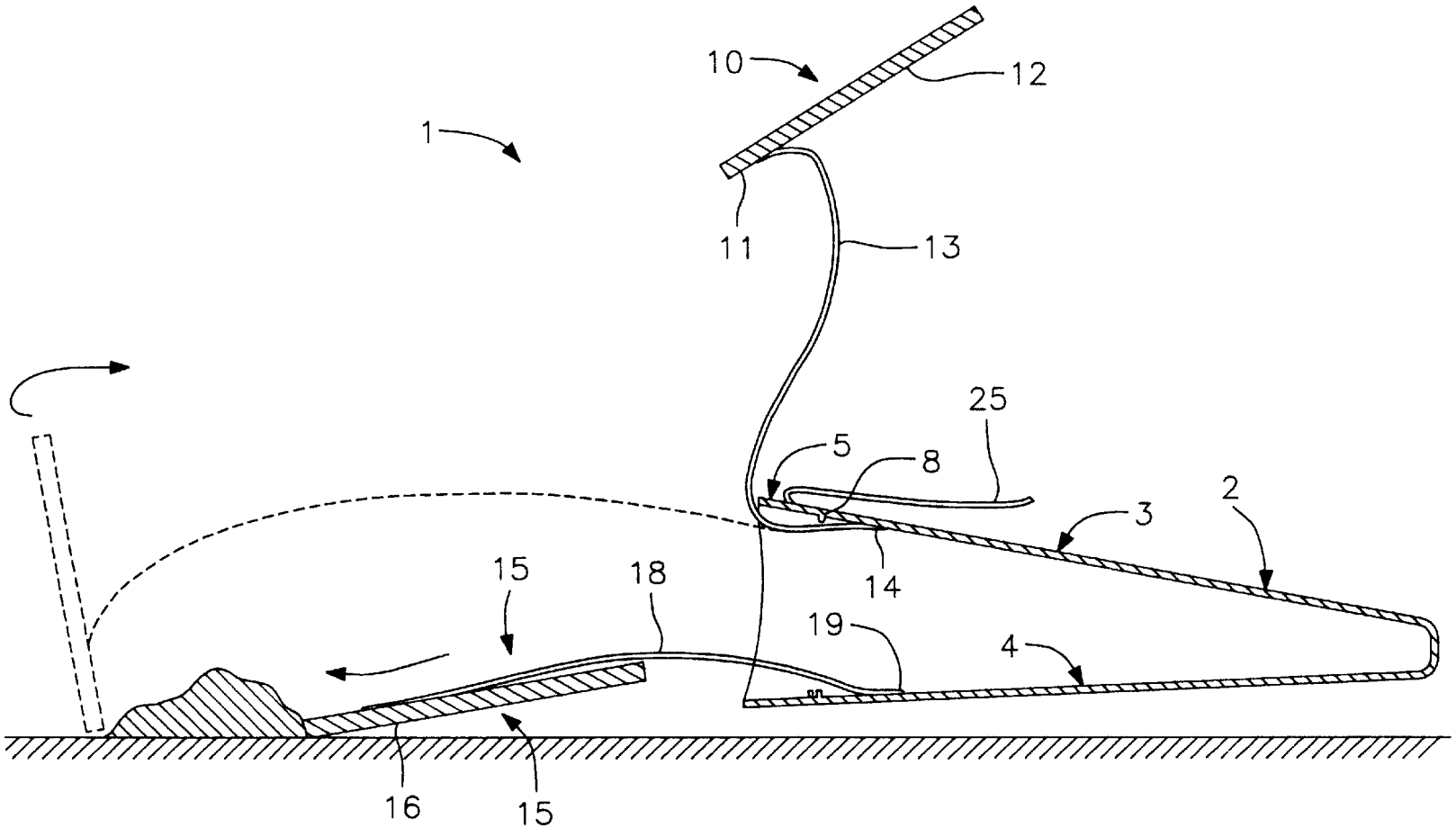
FIG. 1 is a cross-sectional side view showing a disposal device of the invention in use.

Referring to the drawing, there is shown a disposal device 1 of the invention. The disposal device 1 comprises a bag 2 having a first wall 3 and a second wall 4. The bag 2 also comprises a mouth 5 having a press seal 6. The walls 3 and 4 are of opaque plastics material.

The device 1 also comprises a scraper 10 of rigid card material. The scraper 10 comprises a blade 11 and a handle 12 extending from the central part of the blade 11. The scraper 10 is connected to the inside surface of the first bag wall 3 by a chute 13 of plastics material. The chute 13 has approximately the same width as the scraper 10 and it is connected to the first bag wall 3 by a transverse heat seal 14.

Figure 3:
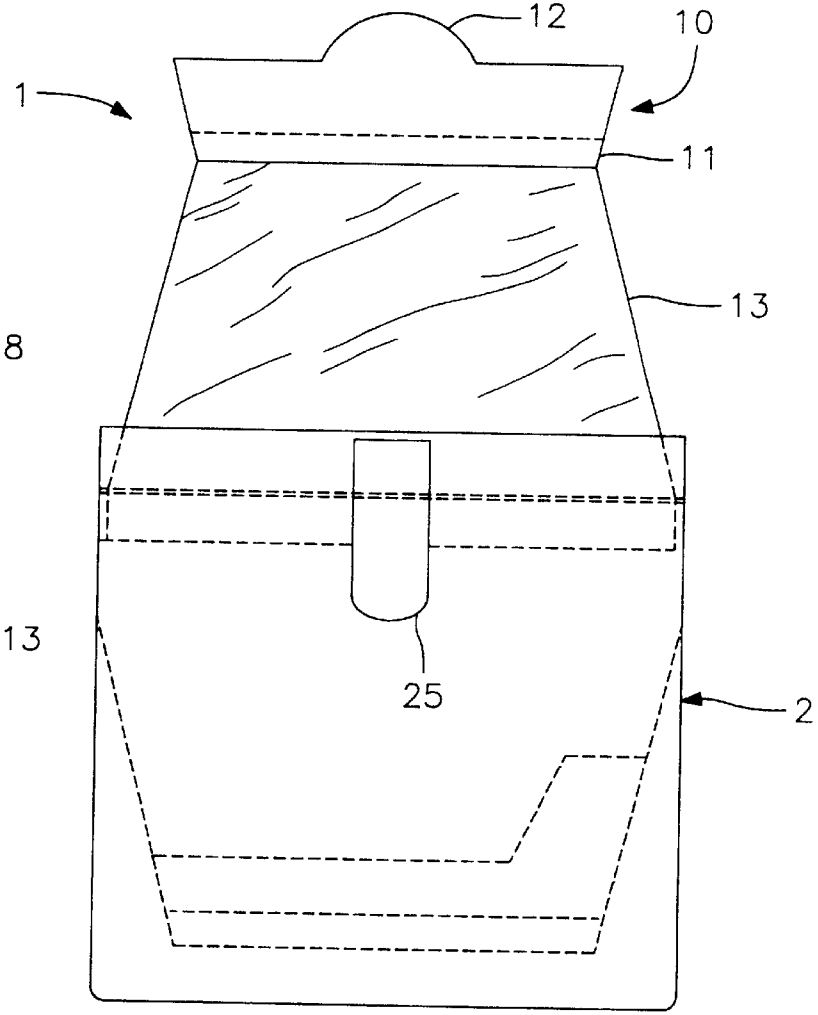
FIG. 2 is an elevational view of the device from one side and FIG. 3 is an elevational view from the other side.
Figure 2:
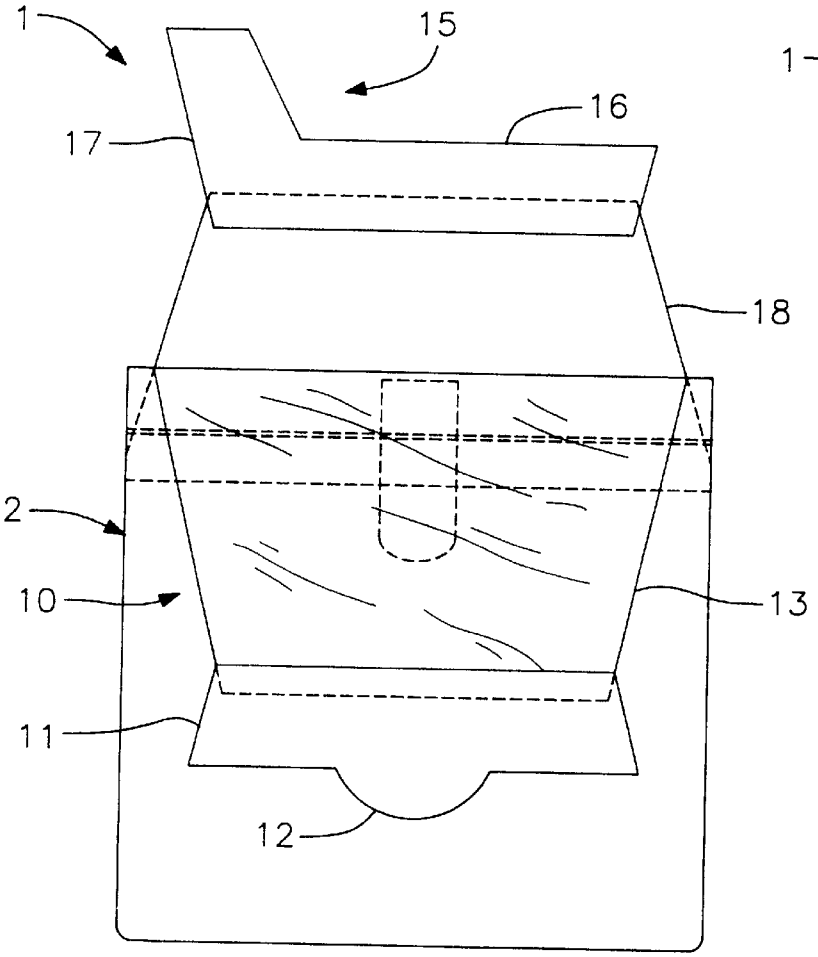
Figure 4:
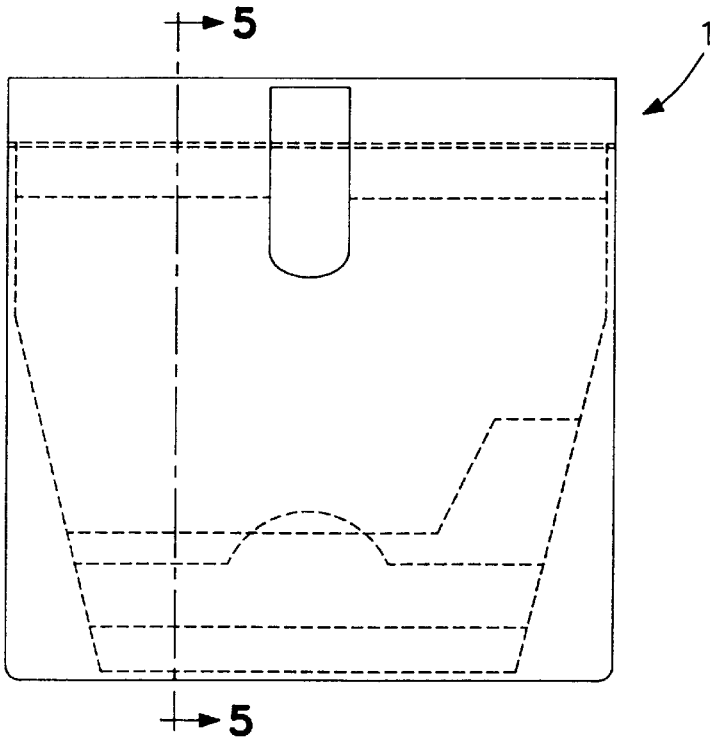
FIG. 4 is an elevational view of the device in a closed position.

The device 1 also comprises a scooper 15 of rigid card material. The scooper 15 comprises a blade 16 and an integral transverse handle 17. The handles 12 and 17 are best viewed in FIGS. 2 and 3. The scooper 15 is connected by a chute 18 of plastics material to the second bag wall 4 at its inner surface. The connection is by way of a transverse heat seal 19, similar to the seal 14. Again, the chute 18 is of approximately the same width as the scooper 15. The positions of the seals 14 and 19 are quite close to the mouth 5.

Figure 5:
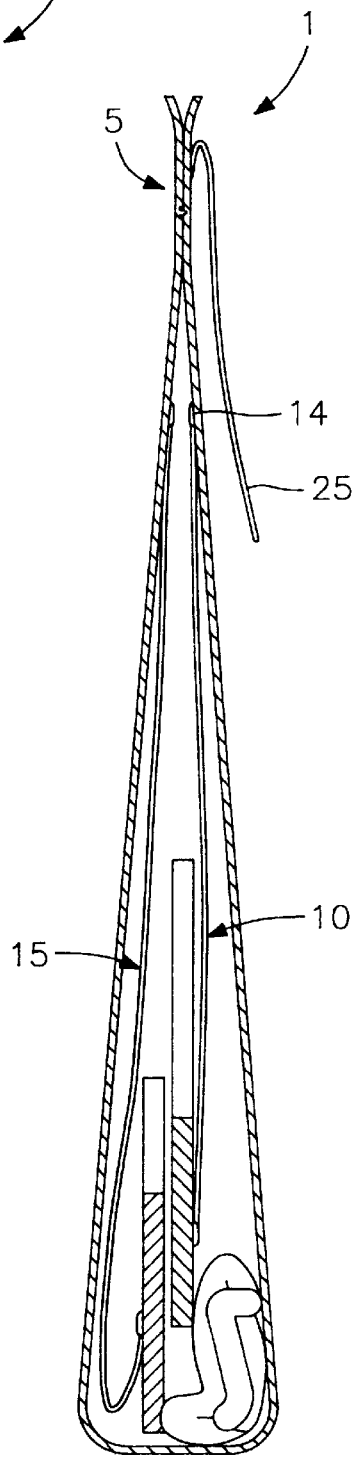
FIG. 5 is a cross-sectional view of the device in the direction of the arrows V—V of FIG. 4.
Figure 6:
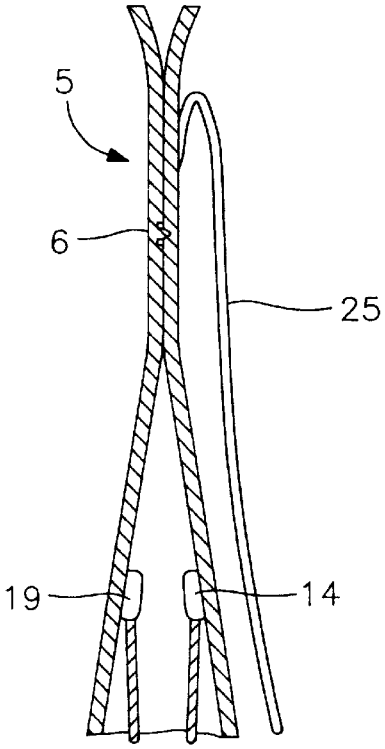
FIG. 6 is a cross-sectional side view of the mouth area of the disposal device on a large scale.
Figure 7A:
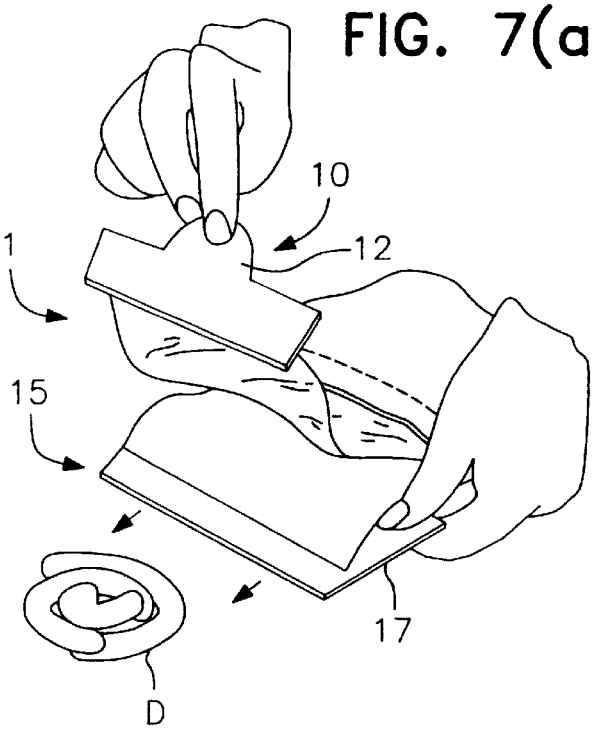
FIG. 7 (*a*) to 7 (*d*) are diagrams showing operation of the device.
Figure 7B:
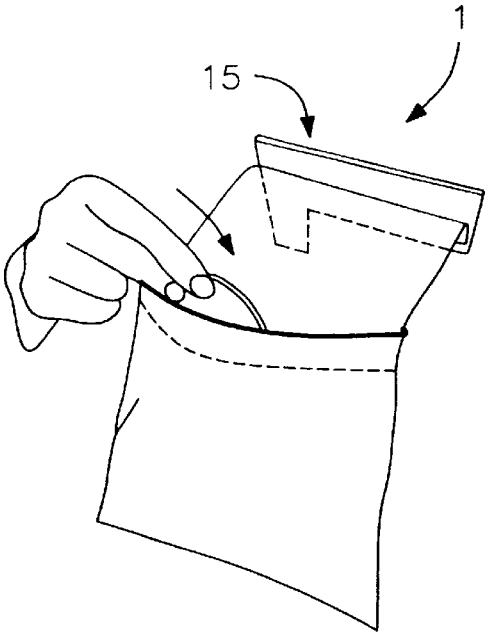
Figure 7C:
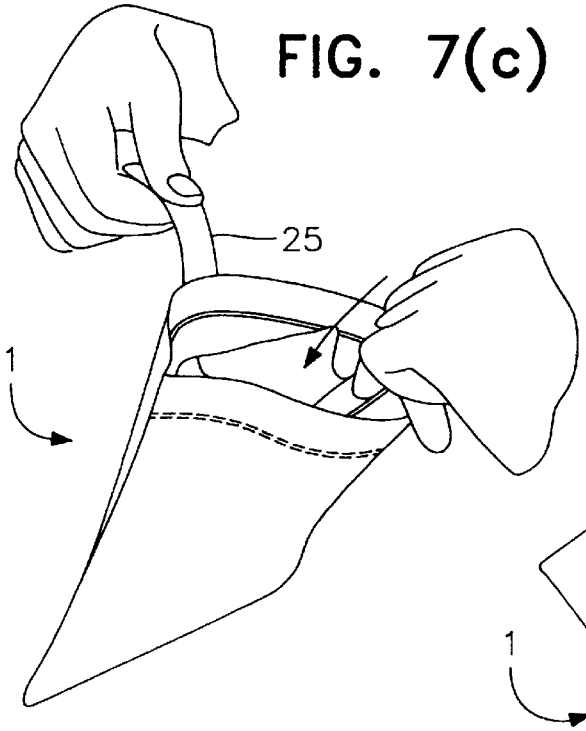
Figure 7D:
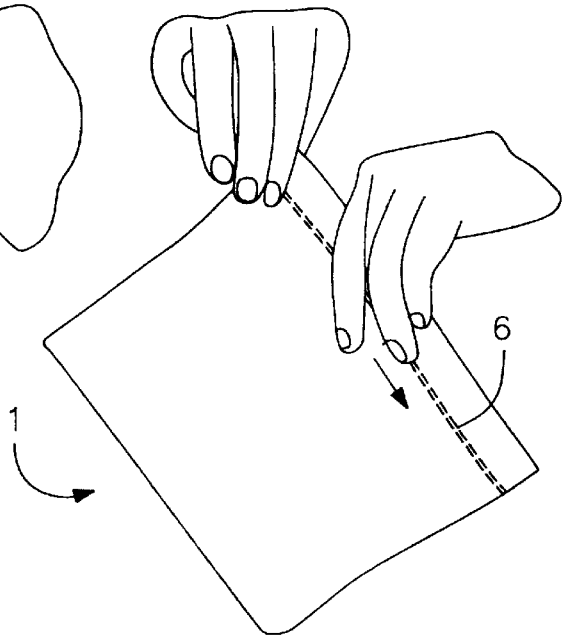

Finally, the device 1 comprises a tab 25 of plastics material connected to the first bag wall 3 at its outer surface close to the mouth 5. The tab 25 is connected to this wall by a heat seal. The mouth area of the device I is best illustrated in FIGS. 5 and 6.

In operation, the disposal device 1 operates in an analogous manner to a dustpan and brush, as illustrated in FIG. 1 and FIGS. 7(*a*) to 7(*d*). As shown in FIG. 7 (*a*), the user holds the scooper 15 by the handle 17 on one side of the device 1. The user also takes the scraper 10 with the other hand, holding it at the handle 12. The scooper 15 is moved downwardly underneath the dirt D to be disposed of. This movement of the scooper 15 underneath the dirt is assisted by the scraper 10 which holds the dirt in position as the scooper moves underneath it. The scraper 10 may additionally be required to scrape some of the dirt towards the scooper 15, depending on the nature and spread of the dirt.

The dirt D is then held on the scooper 15 and when this is lifted up, it falls into the bag 2 via the chute 18. Some of the dirt may also fall into the bag via the chute 13 of the scraper 10. As is clear from FIG. 7(*b*), the scraper is inserted into the bag firstly while the device is being held by the scooper 15. The user then holds the device 1 by the tab 25 while he or she places the scooper 15 into the bag, as shown in FIG. 7(*c*). Of course, the sequence may be reversed, with the device being held initially by the scraper 10.

Finally, as shown in FIG. 7 (*d*) the bag is sealed using the press seal 6.

It will be apparent that disposal of the dirt D has been achieved without the need for the user's hands to come into contact with the dirt. Also, the action for disposal of the dirt D is analogous to that of a conventional dustpan and brush, and thus the action is a very natural and simple action which may be easily performed by the user. The tasks of scooping and at the same time holding or scraping are very simple. These actions also allow for disposal of a wide range of messy dirt, such as dog excrement from the ground, or vomit from a seat fabric. It is very simple for the user to insert both the dirt and the parts of the device 1 which have come into contact with the dirt into the bag without contaminating either his/her hands or any other item, and the bag is then sealed in a very simple manner.

It will also be appreciated that the disposal device 1 has a very simple and compact construction. It takes the form of an envelope and all of the parts of the device 1 are interconnected. Because of the simple and compact construction, it is envisaged that they may be produced in packs of at least 10 items and may therefore be easily stored, for example, in a vehicle glove compartment or in the pocket of a user walking a dog. Also, because of its simplicity, the device is inexpensive to produce.

Another advantage is that the bag is closed after use, with clean outer surfaces. It may therefore be easily carried to the nearest disposal site.

The invention is not limited to the embodiments described, but may be varied in construction and detail within the scope of the claims. For example, it is not necessary that the bag be of plastics material. It may, for example, be of a biodegradable material such as cardboard or any other suitable material. If it is of a material which is not waterproof, the bag wail may be lined on one side. The tab may be on the second bag wall, or there may be a tab on both sides. The scooper may have a different shape, such as a pointed edge, Also, the chutes and the bag walls may be formed from the same sheet of material, with a fastener being attached on the outside to allow the chutes to be inserted and the bag closed. The chutes may also be connected to the bag walls at lower positions, even at the lowermost parts of the bag walls.

What is claimed is:

1. A disposal device comprising:

a bag comprising:

at least two walls, each having an inner surface and an outer surface, and a bag mouth; and a scraper connected to the bag, wherein:

the scraper is connected to a first bag wall at the inner surface of said bag wall, and the device further comprises a scooper connected to a second bag wall at the inner surface of said bag wall, the scraper being connected to the first bag wall by a scraper chute of flexible material, the first bag wall and the scraper chute being of plastics material, and the scraper chute being connected to the first bag wall by a heat seal.

2. A disposal device as claimed in claim 1, wherein the scraper chute has a width approximately equal to that of the scraper.

3. A disposal device as claimed in claim 1, wherein the scooper is connected to the second bag wall by a scooper chute of flexible material.

4. A disposal device as claimed in claim 3, wherein the scooper chute has a width approximately equal to that of a blade portion of the scooper.

5. A disposal device as claimed in claim 1, wherein the scraper comprises an integral handle.

6. A disposal device as claimed in claim 5, wherein the scraper handle extends from a central portion of a blade portion of the scraper.

7. A disposal device as claimed in claim 1, wherein the scooper comprises an integral handle.

8. A disposal device as claimed in claim 7, wherein the handle extends transversely of a blade portion of the scooper.

9. A disposal device as claimed in claim 1, wherein the device further comprises a tab connected to a bag wall at the outer surface of said bag wall adjacent to the bag mouth.

10. A disposal device as claimed in claim 1, wherein the bag mouth comprises a sealing means.

11. A disposal device as claimed in claim 1, wherein the bag is of plastics material.

12. A disposal device as claimed in claim 11, wherein the bag walls are opaque.

13. A disposal device comprising:

a bag comprising:

a bag mouth; and at least two walls extending rearwardly of the bag mouth, each wall having an inner surface and an outer surface;

a scraper of rigid material connected by a scraper chute of flexible material to a first bag wall at the inner surface thereof behind the bag mouth so that the scraper and the scraper chute may be fully contained within the bag; and a scooper of rigid material connected by a scooper chute of flexible material to a second bag wall at the inner surface thereof behind the mouth whereby the scooper and the scooper chute may be fully contained within the bag.

14. A disposal device as claimed in claim 13, wherein the scraper chute has a width approximately equal to that of the scraper.

15. A disposal device as claimed in claim 13, wherein the first bag wall and the scraper chute are of plastics material, and the scraper chute is connected to the first bag wall by a heat seal.

16. A disposal device as claimed in claim 13, wherein the scooper chute has a width approximately equal to that of a blade portion of the scooper.

17. A disposal device as claimed in claim 13, wherein the scraper comprises an integral handle.

18. A disposal device as claimed in claim 17, wherein the scraper handle extends from a central portion of a blade portion of the scraper.

19. A disposal device as claimed in claim 13, wherein the scooper comprises an integral handle.

20. A disposal device as claimed in claim 19, wherein the handle extends transversely of a blade portion of the scraper.

21. A disposal device as claimed in claim 13, wherein the device further comprises a tab connected to a bag wall at the outer surface of said bag wall adjacent to the bag mouth.

22. A disposal device as claimed in claim 13, wherein the bag mouth comprises a sealing means.

23. A disposal device as claimed in claim 13, wherein the bag is of plastics material.

24. A disposal device as claimed in claim 23, wherein the bag walls are of opaque material.

* * * * *